US005575702A

United States Patent [19]

Silvious

[11] Patent Number: 5,575,702

[45] Date of Patent: Nov. 19, 1996

[54] TELESCOPING TUMBLING TOY

[76] Inventor: Frances C. Silvious, P.O. Box 70, Montross, Va. 22520

[21] Appl. No.: 489,767

[22] Filed: Jun. 13, 1995

[51] Int. Cl.[6] ..... A63H 15/08

[52] U.S. Cl. ..... 446/431; 446/324; 446/445; 273/128 R

[58] Field of Search ..... 446/168, 431, 446/437, 445, 396, 324; 273/108, 128 A, 128 R

[56] References Cited

U.S. PATENT DOCUMENTS

| | | | |
|---|---|---|---|
| 622,354 | 4/1899 | Harvey | 273/128 R |
| 1,214,454 | 1/1917 | Gowdey . | |
| 1,254,428 | 1/1918 | Meyers . | |
| 1,272,588 | 7/1918 | White . | |
| 1,373,312 | 3/1921 | Dickerson . | |
| 1,494,963 | 5/1924 | Smith . | |
| 1,614,471 | 1/1927 | Hayashi . | |
| 1,982,633 | 12/1934 | Brown | 446/168 |
| 2,218,207 | 10/1940 | Herzinger . | |
| 3,519,273 | 7/1970 | Viby . | |
| 3,844,562 | 10/1974 | Foley et al. . | |
| 4,213,266 | 7/1980 | Hyland et al. . | |
| 4,238,904 | 12/1980 | Lang . | |

FOREIGN PATENT DOCUMENTS

| | | | |
|---|---|---|---|
| 55-78983 | 6/1980 | Japan . | |
| 1720674 | 3/1992 | U.S.S.R. | 446/396 |
| 197110 | 5/1923 | United Kingdom . | |

*Primary Examiner*—Robert A. Hafer
*Assistant Examiner*—Jeffrey D. Carlson
*Attorney, Agent, or Firm*—Richard C. Litman

[57] ABSTRACT

A tumbling toy includes a shell or housing formed of two or more telescoping sections, providing adjustment of the length of the shell and thus the moment of inertia of the toy to affect the tumbling rate. Extending the telescoping housing increases the moment of inertia of the toy, and provides a longer path of travel for the mass within the shell, resulting in a slower rate of tumble for a given slope. The sections may be separated also, allowing the mass contained within to be exchanged for one of greater or lesser mass, which also affects the tumbling rate of the toy. The outer shell sections may be made of plastic or other suitable material, with the moving mass contained therein comprising a marble or the like, or a steel or other metal ball bearing or the like, or a lead sphere or other suitable shape. An internal mass of less than the mass of the shell structure may be provided if desired, as well as masses substantially equal to the shell, or greater than the shell, as desired. The tumbling surface of the toy may be partially or completely coated with a material having a high coefficient of friction (e.g., rubber or soft vinyl, etc.) in order to provide a better grip on a surface and preclude slipping of the toy.

19 Claims, 2 Drawing Sheets

TELESCOPING TUMBLING TOY

FIELD OF THE INVENTION

The present invention relates generally to toys which are adapted to produce a motion when activated, and more specifically to a tumbling toy which contains a longitudinally movable mass within a hollow body. The body is formed of two or more telescoping segments, in order to adjust the moment of inertia of the body according to the adjusted length of the telescoped segments, and further to provide interchangeability of different: masses within the body, to affect the tumbling rate.

BACKGROUND OF THE INVENTION

Toys and the like which provide some form of action, particularly a repeating complex motion of some sort, are generally fascinating to people, particularly to younger children. Relatively simple means of providing such action in an unpowered toy has been developed in the past, as will be discussed in the Description of the Prior Art following. These toys rely upon a mass which is free to shift its position longitudinally within the body of the toy, as the body tumbles end over end down a slope. The resulting action is a repeating end over end action, generally with some delay in each half revolution due to the time it takes for the enclosed mass to roll from one end of the body to the other. However, persons will generally quickly tire of watching such a toy, due to the consistent rate of the tumbling action. With a body of fixed length, and an internal weight of fixed mass, the tumbling rate cannot be varied and will remain constant.

What is needed is a tumbling toy which provides for changes of the length of the body (particularly the internal length traveled by the moving mass within), and/or the mass contained within, in order to adjust the moment of inertia of the toy to provide different tumbling rates. The toy must provide for simple and rapid adjustment of length and/or internal mass, so that the adjustment may be made by children playing with the toy, rather than requiring intervention by an adult or older person.

DESCRIPTION OF THE PRIOR ART

U.S. Pat. No. 1,254,428 issued to Hubert A. Myers on Jan. 22, 1918 describes a Tumbling Toy having two flat, parallel sides each having an oval shaped periphery. A round ball is enclosed within a central tube which runs the length of the device. The toy is operated by placing it on an inclined surface or slope with the flat sides perpendicular thereto and the central tube and major axis of the toy oriented in the direction of the slope, and released. The glass of the internal ball travels the length of the tube to the lowermost rounded end, and causes that end to rotate down the slope along the rounded edges of the sides. The action is repeated as the internal ball again rolls from one end of the internal tube to the other, resulting in a tumbling, end over end action. However, the toy is completely sealed, and neither its length, the length of the internal tube in which the spherical mass rolls, nor the mass itself, may be changed or adjusted in any way. Thus, the moment of inertia of the toy is fixed, with the only adjustment being the degree of slope down which it tumbles. The resulting tumbling rate is constant for any degree of slope, and cannot be adjusted to provide greater interest.

U.S. Pat. No. 1,494,963 issued to Elbert L. Smith on May 20, 1924 describes a Container Toy which operates on the same general principle described above. The toy includes oppositely disposed "feet," which affect the tumbling action. An openable flap is described by Smith, whereby a person may remove an article of candy or the like from within the hollow center, and replace it with a mass (marble, etc.). However, Smith makes no suggestion that the tumbling rate may be altered by changing the mass within the body; rather, he relies strictly upon the "feet" extending from the body to provide additional interest to the tumbling action. The body is of fixed length, and cannot be adjusted, and yet the length of the body will be seen to have a greater effect upon the tumbling action than a corresponding change in mass.

U.S. Pat. No. 1,614,471 issued to Andrew T. Hayashi on Jan. 18, 1927 describes a Japanese Peanut Ping Pong Game wherein a peanut shaped hollow container with a spherical mass therein, is released to travel randomly down a slope and trip a scoring switch or light at the end of its path. The peanut is generally realistically shaped, which means it can also roll about its longitudinal axis, as well as tumble end over end. As the moment of inertia is lower about the longitudinal axis, the peanut shape will generally take the path of least resistance and roll about that axis rather than tumbling end over end, as is provided by the shape of the present toy with its square or rectangular cross section. Moreover, the halves of the shell are sealed, precluding any exchange of different masses within the shell, and the shell cannot be telescoped to change the length and moment of inertia, as provided by the present toy.

U.S. Pat. No. 3,519,273 issued to Jette Viby on Jul. 7, 1970 describes a Combined Tumbling Toy With Ribs And Ball wherein the housing or shell has a generally elliptical cross section, resulting in a greater rolling action for the toy over a longer distance, with all other factors being equal. The Viby toy also has a round cross section, making it more likely to roll about its longitudinal axis than to tumble, as in the peanut shaped device of the Hayashi patent discussed further above. While Viby describes a shell having a mass less than that of the internal ball, he also permanently encloses the mass within the shell so that it cannot be exchanged for a greater or lesser mass. Also, the Viby housing or shell cannot be telescoped, even if the construction otherwise permitted, due to its elliptical shape.

U.S. Pat. No. 4,213,266 issued to Joseph F. Hyland et al. on Jul. 22, 1980 describes a Tumbling Toy wherein the side walls of the tube are curved similarly to the Viby device discussed above. The Hyland et al. toy also has a circular cross section, as in the Viby toy, but Hyland et al. appear to recognize the lack of restriction to a tumbling motion that such a rounded section would allow, and provide a narrow, arcuate track or rocker in which the toy is restricted to an end over end tumbling action. The shell or housing for the toy is permanently assembled, precluding any exchange of the mass therein or extension of the length of the housing to change the moment of inertia of the toy.

U.S. Pat. No. 4,238,904 issued to Dorothy M. Lang on Dec. 16, 1980 describes a Toy Displaying Erratic Tumbling Movement, comprising a triangular shaped housing with a ball enclosed therein. The edges of the triangular housing are round, to enable the device to turn from one side to the other as it moves down a slope. The weighted sphere or ball within the Lang device is permanently enclosed therein, and cannot be removed to provide for greater or lesser weights. The apices of the triangle are open, but the openings are not sufficiently large to allow the mass contained therein to be removed. Lang notes that the external surface may have a high coefficient of friction, but the ball captured within the device must have a relatively lower coefficient of friction in order to roll smoothly within the housing. Thus, when the ball happened to come in contact with the underlying surface through one of the apex openings, slippage could occur. The present toy is elongate and completely enclosed during operation, regardless of the length of the telescoped housing.

British Patent Publication No. 197,110 to Harry S. Kamiya and published on May 10, 1923 describes an Apparatus For Use In Playing A Game Of Skill, wherein an elongate tumbling device somewhat like that described in the patent to Myers (discussed above) is used in the play of a game. The object is to allow for the tumbling action and cause the tumbling device to drop into a hole in the inclined surface, to win a prize. No adjustment of the tumbling device is disclosed in the Kamiya patent publication.

Finally, Japanese Patent Publication No. 55-78983 to Nitto Electric and published on Jun. 14, 1980 describes a tumbling toy having an outer surface at least partially coated with a highly plastic rubber gel, enabling the toy to grip highly inclined surfaces. Both oval and square configurations are shown. While the present toy also makes use of surface materials having a high coefficient of friction, the Nitto Electric toy makes no provision for telescoping to change the length and moment of inertia of the toy or changing the internal mass to one of greater or lesser mass.

None of the above noted patents, taken either singly or in combination, are seen to disclose the specific arrangement of concepts disclosed by the present invention.

SUMMARY OF THE INVENTION

By the present invention, an improved tumbling toy is disclosed.

Accordingly, one of the objects of the present invention is to provide an improved tumbling toy which incorporates a shell or housing which comprises two or more telescoping portions, thereby providing for the extension of the housing along its longitudinal axis to change the moment of inertia and tumbling rate of the toy.

Another of the objects of the present invention is to provide an improved tumbling toy which telescoping sections are separable, providing access to the interior of the housing to allow the exchange of the mass contained therein for one having greater or lesser mass, thereby also changing the moment of inertia of the toy.

Yet another of the objects of the present invention is to provide an improved tumbling toy which internal rolling mass may be greater than, equal to, or less than the mass of the housing in which it is contained.

Still another of the objects of the present invention is to provide an improved tumbling toy which housing may be formed of plastic or other suitable material, and which internal mass may comprise a marble, a steel or other metal ball bearing or the like, or a generally spherical lead mass, depending upon the results desired.

A further object of the present invention is to provide an improved tumbling toy which includes at least a partial coating thereon of a high friction coefficient substance, thereby precluding slippage on inclined surfaces.

A final object of the present invention is to provide an improved tumbling toy for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DESCRIPTION OF THE PREFERRED EMBODIMENTS

Figure 1:
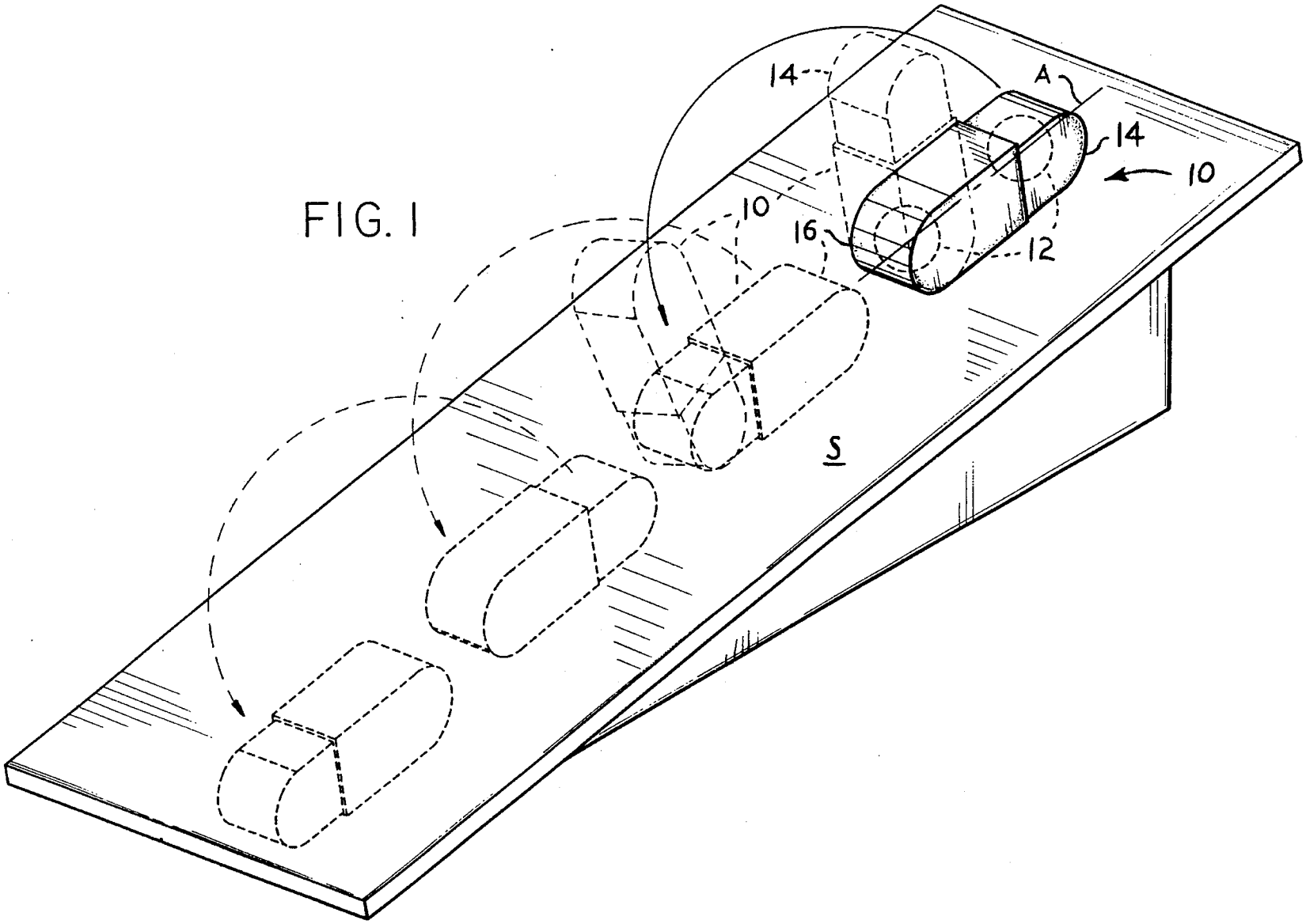
FIG. 1 is a perspective view of the present tumbling toy, showing its tumbling action down an inclined surface or slope.

Referring now particularly to FIG. 1 of the drawings, the present invention will be seen to relate to a telescoping tumbling toy 10, adapted to tumble end over end down an inclined plane or slope S, as the internal weight or mass 12 rolls or shifts from one end to the other of the toy. Various configurations of such toys based upon the general concept have been developed in the past, but the present toy includes a first section 14 and an opposite second section 16, which sections 14 and 16 are telescopingly assembled to one another and are further separable from one another, to provide access to the weight or mass 12 loosely installed therein. By telescoping the two sections 14 and 16 together or apart, the overall length of the toy 10 may be altered, and/or the sections 12 14 and 16 may be separated to allow the weight 12 therein to be exchanged for one of greater or lesser mass, as desired.

Figure 2:
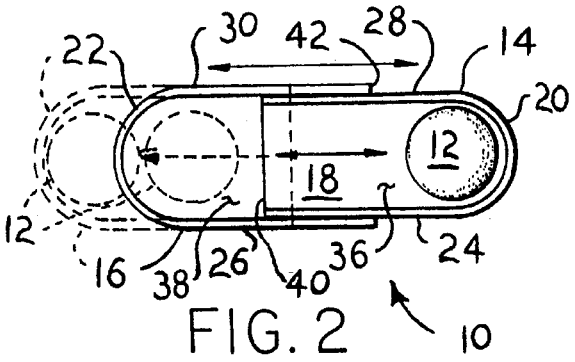
FIG. 2 is a side elevation view in section of a first embodiment of the present tumbling toy, showing the telescoping action of the two part housing to change the length and moment of inertia of the housing and toy.
Figure 4:
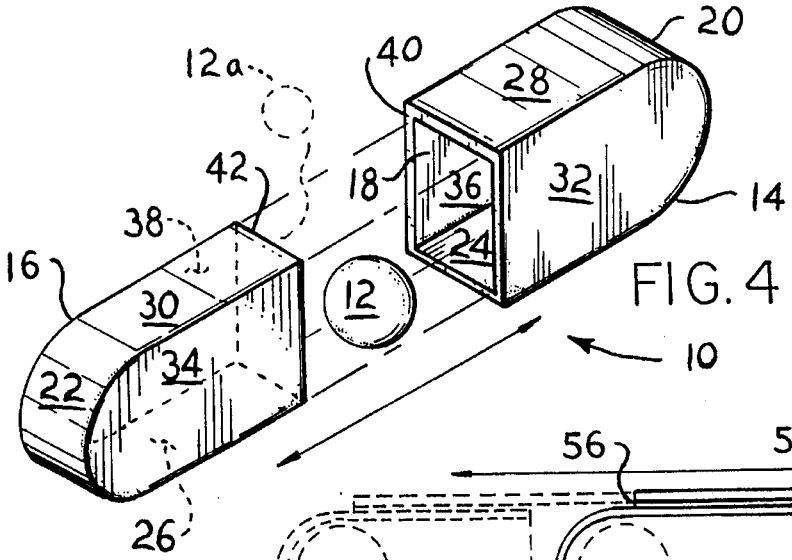
FIG. 4 is an exploded perspective view of the tumbling toy of the first embodiment, showing the separability of the two housing portions and the interchangeability of the mass contained herein.
Figure 3:
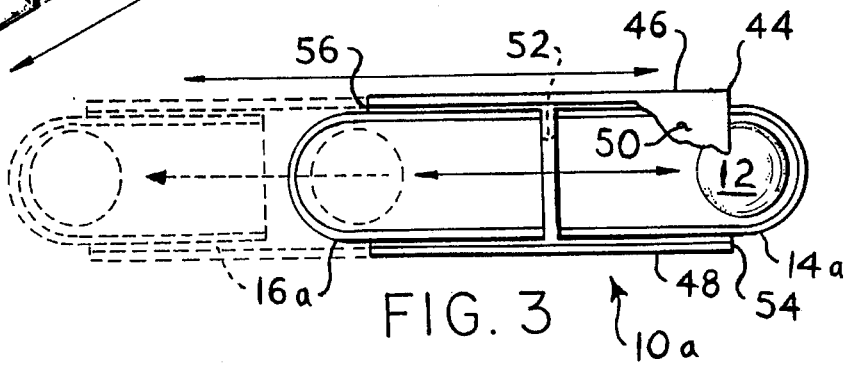
FIG. 3 is a side elevation view in section of a second embodiment of the present tumbling toy, showing the telescoping action of a multiple part housing to change the length and moment of inertia of the housing and toy.

The embodiment of the present toy 10 shown in FIG. 1 is shown in further detail in FIGS. 2 through 4 of the drawings. Toy 10 includes a hollow interior 18 enclosed by a first end section 14 and an oppositely disposed second end section 16 telescopingly assembleable together, as noted above. Each section 14 and 16 includes a convex (preferably semicircular) first end (respectively 20 and 22), opposite first contact panels 24 and 26 and second contact panels 28 and 30, and opposite first side walls 32 and 34 and second side walls 36 and 38. The contact panels 24 through 30, along with the opposite ends 20 and 22 of the first and second sections 14 and 16, serve as contact surfaces for the toy 10 as it tumbles down a slope S. Each section 14 and 16 also has an open second end, respectively 40 and 42, through which the weight 12 may pass as it moves from one section to the other as the toy 10 tumbles downslope.

It will be noted that the two telescoping sections 14 and 16 fit closely together, so that the second section 16 has a friction fit within the first section 14, and will tend to maintain its position relative to the first section 14 until manually adjusted to another position. This reasonably tight fit between the two sections 14 and 16 ensures that the two sections will maintain any specific setting or position once adjusted, and thus maintain a given overall length, rather than shifting as the toy tumbles and thereby changing the moment of inertia and tumbling rate of the toy 10. This relatively tight fit also ensures that the two sections 14 and 16 do not inadvertently separate during tumbling, thereby releasing the weight 12 contained therein.

However, the frictional fit between the two sections 14 and 16 does provide for the deliberate separation of the two sections by a person using the present toy 10 if desired, as indicated in FIG. 4. This allows the weight 12 therein to be removed and exchanged for a weight 12*a* having a different mass (greater or lesser, as desired), to change the moment of inertia and rate of tumble of the assembled toy 10 as desired. While generally it will be desirable to provide a weight 12 having a greater mass than the shell comprising components 14 and 16, it will be seen that a weight 12*a* may be substituted with a mass less than or equal to that of the shell, if desired. As the tumbling action is initiated by the weight rolling into the lower convex end of one of the sections 12 or 14, and thus overbalancing the mass of those sections and causing the assembled sections to tumble end over end, it will be seen that the shallower the slope S, the greater the mass of the weight 12 required relative to the mass of the assembled components 14 and 16 to produce the desired tumbling action. However, for relatively steep slopes, a smaller mass is capable of causing the desired tumbling action.

The weights 12/12*a* or other, may comprise spherical objects, such as a marble, a steel or other metallic ball bearing, or a lead weight, as desired. Alternatively, other non-spherical shapes may be provided for the weights, as desired. For example, a cylindrical weight will roll just as readily within the hollow interior 18 of the toy 10, but will possess a slightly greater moment of inertia due to its cylindrical shape as opposed to the spherical shape shown in the drawings. Other shapes (polyhedrons, hexagonal or octagonal parallelipipeds, etc.) may also be used, which shapes will each have a different effect upon the tumbling action.

The tumbling rate of the present toy 10 (and others relying upon the same principle) is dependent upon a relatively complex mechanical action involving the moment of inertia of the hollow shell comprising the two sections 14 and 16 along its longitudinal axis A, and that of the weight 12/12*a* captured therein. Moment of inertia is a mathematical expression describing the resistance of a body to rotation about a given axis, and is dependent upon the mass of the body multiplied by the square of its dimension or arm along the given axis. Thus, any increase in the mass of the body (which includes the loose weight 12 captured therein, in the case of toy 10), or increase in the length of the body (i.e., the two shell sections 14 and 16), will result in an increase in the moment of inertia of the toy. An increase in the overall length of the shell sections 14 and 16 of the toy 10 will be seen to increase the moment of inertia of the toy 10 more than a corresponding increase of the internal weight 12, due to (1) the effect on the moment of inertia due to the squaring of the length increase, and (2) the increased time required for the weight 12 to roll from one end to the other of the increased length of the toy 10.

Accordingly, additional telescoping sections may be provided, as shown in a second embodiment 10*a* in FIG. 3 of the drawings. The toy 10*a* comprises a first end section 14*a* and an oppositely disposed second end section 16*a*, similar to the two end sections 12 and 14 of FIGS. 1, 2, and 4 discussed above. However, rather than telescoping directly to one another, one or more telescoping intermediate sections 44 may be provided, with the two end sections 14*a* and 16*a* telescoping with these intermediate sections 44. (While only one intermediate section 44 is shown in FIG. 3, it will be understood that additional sections may be provided, so long as they are configured in a manner to provide the required closely fitting frictionally adjustable telescoping action with one another, and with the ends 14*a* and 16*a*. Clearances are exaggerated in FIG. 3 for clarity.) The intermediate section(s) 44 are configured similarly to the ends 14*a*/16*a*, having a rectangular cross section, opposite first and second contact surfaces or panels 46 and 48, and opposite first and second side walls 50 and 52. However, each intermediate section 44 includes a first and an opposite second open end 54 and 56, with which one of the two end sections 14*a*/16*a* (or another intermediate section 44, appropriately sized) may telescope. Thus, a telescoping tumbling toy 10*a* may be: constructed which has a relatively high moment of inertia (and thus a relatively slow tumbling rate), due to the length of the assembled body or shell 10*a*. Such a toy 10*a* would likely require a weight 12 therein having a relatively large mass, in order to overcome the mass of the shell 10*a* and its length or arm, but the interchangeability of the weights 12, 12*a* or other by means of the disassembly of the various components 14*a*/14*b*/44, in the manner described above for the first embodiment shown in FIGS. 1, 2, and 4, permits such interchangeability with ease.

Preferably, the various components comprising the shell of the present toys 10/10*a* (i.e., end components 14/16 and/or 14*a*/16*a* and any intermediate sections 44) are formed of plastic, for economy, durability, and ease of manufacture. Many manufactured plastic surfaces have a relatively low coefficient of friction, which is undesirable in the present toy 10/10*a*, at least on the rounded ends and first and second contact surfaces which are alternating in contact with the surface of the underlying slope as the toy 10/10*a* tumbles downwardly therealong.

Figure 5:
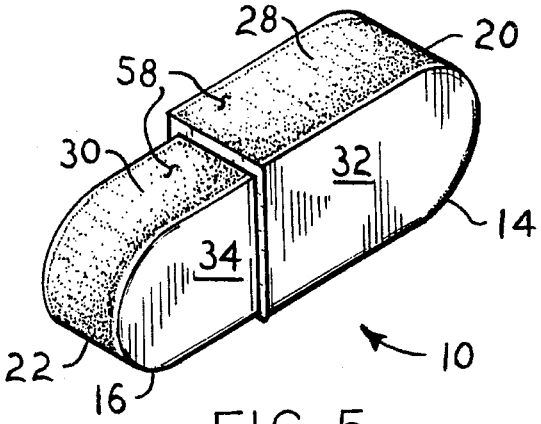
FIG. 5 is a perspective view of a tumbling toy of the first embodiment, showing a tumbling surface coated with a material having a high coefficient of friction for better grip on a sloped surface.

Accordingly, the present toy 10/10*a* may include some means of providing a relatively high coefficient of friction to those contact surfaces and ends, so that they will better "grip" the underlying slope surface to provide the desired tumbling action, rather than merely sliding downward along the slope without tumbling. This friction means may comprise a coating 58 extending essentially continually over the contact surfaces, as shown on the surfaces 28 and 30 and ends 20 and 22 in FIG. 5 (it will be understood that the coating is also provided on the opposite contact surfaces which cannot be seen in FIG. 5). This friction means or coating 58 may be a relatively soft gum rubber, or other suitable material providing a relatively good "grip" when placed upon another surface.

Figure 6:
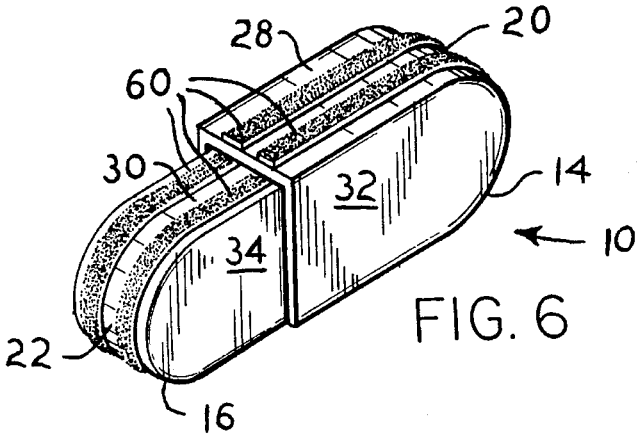
FIG. 6 is a perspective view of an alternate means of providing a tumbling surface having a high coefficient of friction, wherein two spaced apart bands of such material are provided.

Alternatively, the friction means may comprise two or more bands 60 of such material, as shown in FIG. 6. In fact, a plurality of rubber bands may be wrapped about the present toy 10 to serve this purpose, if desired. However, it will be understood that such bands would tend to draw the various sections 14/16 (or 14*a*/16*a*/44) together, due to the tensile forces produced by the bands. Accordingly, it is preferred that any such bands of high friction material be provided as permanent spaced apart bands 60 extending substantially completely about the contact surfaces of the toy 10.

In summary, telescoping tumbling toy 10/10*a* will be seen to provide an enjoyable action toy which action may be easily modified or adjusted merely by changing the length of the toy by telescoping the various end sections and/or intermediate section(s) to lengthen or shorten the overall length, as desired, to increase or decrease the moment of inertia of the toy 10/10*a*. As the telescoping sections may be separated from one another, access to the weight 12/12*a* is provided, thereby allowing the weight to be exchanged for one of greater or lesser mass, as desired in order to alter further the moment of inertia of the toy. The present toy 10/10*a* is extremely simple and economical to manufacture, and provides an excellent means of demonstrating the principles of moment of inertia to science and engineering students, and/or others interested in the subject. The many means provided of altering the tumbling rate, including altering the slope of the inclined surface, adjusting the length of the body of the toy, and/or adjusting the mass and configuration of the weight within the toy, permit persons to adjust these variables to see their effects upon the tumbling rate of the toy, and provide additional interest in the toy over earlier known devices in which the tumbling rate was fixed.

It is to be understood that the present invention is not limited to the sole embodiments described above, but encompasses any and all embodiments within the scope of the following claims.

I claim:

1. A telescoping tumbling toy, comprising:

an elongate shell having a hollow interior and including a first section and a second section, each having a substantially rectangular cross section, a first and an opposite second contact panel each of substantially planar configuration, a closed first end having a convex curvature and extending between said first and said second contact panel, an open second end disposed opposite said closed first end, and a first and an opposite second side wall each of substantially planar configuration and extending between said first and said second contact panel;

said shell second section having an exterior shape and size configured to fit closely within and to be frictionally and adjustably gripped within said second end of said shell first section, thereby providing for the relative telescoping of said first section and second section and further providing an adjustable length for said shell;

a first weight loosely disposed within said shell, said first weight being free to move between said first end of said first section and said first end of said second section, and;

at least a second weight having a different mass than said first weight;

said first section and said second section being separable and openable to provide access to said hollow interior of said shell and said first weight is removable from said shell to provide for the interchangeability thereof within said shell, whereby;

said first weight may be removed from said shell and said second weight may be installed therein, thereby adjusting the moment of inertia of said toy comprising said shell and said second weight therewithin and accordingly adjusting the tumbling rate of said tumbling toy when said tumbling toy is placed upon a slope to tumble down the slope on said convex first end, said first contact surface, said convex second end, and said second contact surface of said toy; and whereby;

said first section and said second section may be telescopingly adjusted relative to one another to adjust said length of said shell, thereby adjusting the moment of inertia of said toy and accordingly adjusting the tumbling rate of said tumbling toy when said tumbling toy is placed upon a slope to tumble down the slope on said convex first end of said first section, said first contact surface, said convex first end of said second section, and said second contact surface of said toy.

2. The telescoping tumbling toy of claim 1, wherein:

said shell has a mass, and said first weight has a mass greater than said shell.

3. The telescoping tumbling toy of claim 1 wherein:

said shell has a mass, and said first weight has a mass substantially equal to said shell.

4. The telescoping tumbling toy of claim 1, wherein:

said shell has a mass, and said first weight has a mass less than said shell.

5. The telescoping tumbling toy of claim 1, including:

friction means for frictionally engaging a tumbling surface, said friction means being disposed upon each said contact panel and upon said closed first end and said closed second end, said friction means comprising a substantially continuous coating of material having a high coefficient of friction.

6. The telescoping tumbling toy of claim 1, including:

friction means for frictionally engaging a tumbling surface, said friction means being disposed upon each said contact panel and upon said closed first end and said closed second end, said friction means comprising a plurality of spaced apart bands of material having a high coefficient of friction.

7. The telescoping tumbling toy of claim 1, wherein:

each said closed end has a semicylindrical curvature.

8. The telescoping tumbling toy of claim 1, wherein:

said shell is formed of plastic.

9. The telescoping tumbling toy of claim 1, wherein:

said first weight is selected from the group consisting of a spherical marble, a steel sphere, and a lead sphere.

10. A telescoping tumbling toy, comprising:

an elongate shell having a hollow interior and including a first end section and a second end section oppositely disposed thereto, each having a substantially rectangular cross section, a first and an opposite second contact panel each of substantially planar configuration, a closed first end having a convex curvature and extending between said first and said second contact panel, an open second end disposed opposite said closed first end, and a first and an opposite second side wall each of substantially planar configuration and extending between said first and said second contact panel;

said shell further including at least one intermediate section having a substantially rectangular cross section, a first and an opposite second contact panel each of substantially planar configuration, an open first end with an open second end disposed opposite said open first end, and a first and an opposite second side wall each of substantially planar configuration and extending between said first and said second contact panel;

said shell first end section and opposite second end section each having an exterior shape and size configured to fit closely within and to be frictionally and adjustably gripped within said at least one intermediate section, thereby providing for the relative telescoping of said first end section, said at least one intermediate section, and said second end section and further providing an adjustable length for said shell, and;

a first weight loosely disposed within said shell, said first weight being free to move between said first end of said first end section and said first end of said second end section and through said at least one intermediate section, whereby;

said first end section, said at least one intermediate section, and said second end section may be telescopingly adjusted relative to one another to adjust said length of said shell, thereby adjusting the moment of inertia of said toy comprising said shell and said first weight therewithin and accordingly adjusting the tumbling rate of said tumbling toy when said tumbling toy is placed upon a slope to tumble down the slope on said convex first end of said first end section, said first contact surface, said convex first end of said second end section, and said second contact surface of said toy.

11. The telescoping tumbling toy of claim 10, wherein:

said first section, said at least one intermediate section, and said second section are separable and openable to provide access to said hollow interior of said shell and said first weight is removable from said shell to provide for the interchangeability thereof within said shell, and;

at least a second weight having a different mass than said first weight, whereby;

said first weight may be removed from said shell and said second weight may be installed therein, thereby adjusting the moment of inertia of said toy comprising said shell and said second weight therewithin and accordingly adjusting the tumbling rate of said tumbling toy when said tumbling toy is placed upon a slope to tumble down the slope on said convex first end of said first end section, said first contact surface, said convex first end of said second end section, and said second contact surface of said toy.

12. The telescoping tumbling toy of claim 10, wherein:

said shell has a mass, and said first weight has a mass greater than said shell.

13. The telescoping tumbling toy of claim 10, wherein:

said shell has a mass, and said first weight has a mass substantially equal to said shell.

14. The telescoping tumbling toy of claim 10, wherein:

said shell has a mass, and said first weight has a mass less than said shell.

15. The telescoping tumbling toy of claim 10, including:

friction means for frictionally engaging a tumbling surface, said friction means being disposed upon each said contact panel and upon said closed first end of said first section and said closed first end of said second section, said friction means comprising a substantially continuous coating of material having a high coefficient of friction.

16. The telescoping tumbling toy of claim 10, including:

friction means for frictionally engaging a tumbling surface, said friction means being disposed upon each said contact panel and upon said closed first end of said first end section and said closed first end of said second end section, said friction means comprising a plurality of spaced apart bands of material having a high coefficient of friction.

17. The telescoping tumbling toy of claim 10, wherein:

each said closed end has a semicylindrical curvature.

18. The telescoping tumbling toy of claim 10, wherein:

said shell is formed of plastic.

19. The telescoping tumbling toy of claim 10, wherein:

said first weight is selected from the group consisting of a spherical marble, a steel sphere, and a lead sphere.

* * * * *